US010325575B1

(12) United States Patent
Barker

(10) Patent No.: US 10,325,575 B1
(45) Date of Patent: Jun. 18, 2019

(54) GUITAR SPEEDLE

(71) Applicant: Jaycib Louis Barker, Herkimer, NY (US)

(72) Inventor: Jaycib Louis Barker, Herkimer, NY (US)

( * ) Notice: Subject to any disclaimer, the term of this patent is extended or adjusted under 35 U.S.C. 154(b) by 0 days.

(21) Appl. No.: 15/987,947

(22) Filed: May 24, 2018

(51) Int. Cl.
*G10D 3/10* (2006.01)

(52) U.S. Cl.
CPC ..... *G10D 3/10* (2013.01)

(58) Field of Classification Search
CPC ..... G10D 3/10
See application file for complete search history.

(56) References Cited

U.S. PATENT DOCUMENTS 572,677 A * 12/1896 Goodwin ..... G10D 3/14 84/297 R
4,202,240 A * 5/1980 Smith ..... G10D 3/12 84/297 R
7,098,391 B2 * 8/2006 Wilson ..... G10D 3/00 84/453
7,365,255 B1 * 4/2008 Piskulic ..... G10D 3/04 84/298
D662,128 S * 6/2012 Nuttall ..... D17/20

* cited by examiner

*Primary Examiner* — Robert W Horn

(57) ABSTRACT

A small tool, tube like in nature, comprised of plastic, metal, or composite material, that makes changing guitar strings easier by insertion into guitar then feeding string though.

2 Claims, 2 Drawing Sheets

Side view

Side view

Top view

GUITAR SPEEDLE

BACKGROUND

Anyone who has strung a guitar with a string through body understands the plight and struggle that goes along with the procedure. Stringing in this matter entails holding the guitar up in such a fashion that one can see light coming through the body to carefully guide the string through from the back to the front. There are certain facets and lips within the bodies of string through guitars that make this operation quite a chore. It is very easy for the strings to get caught while stringing.

SUMMARY

With my invention, the Guitar Speedle makes the process easier and faster. The concept is simple. One can complete the task of guitar stringing much like needling a thread with great speed. Hence the name is the Guitar Speedle.

DETAILED DESCRIPTION

Figure 1:
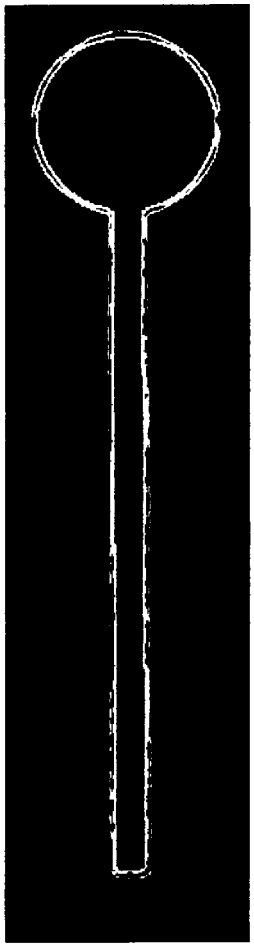
FIG. 1 is an outline of the needle-like Guitar Speedle on a checked background, showing the spherical head and the tube.
Figure 2:
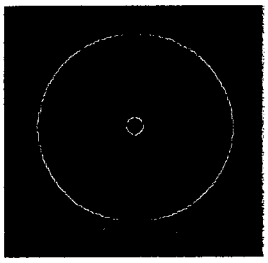
FIG. 2 is a silhouette of the spherical head from a top view of the Guitar Speedle.

The product in question, FIGS. 1 and 2, is inserted into the guitar from the front and the string is then inserted into the Guitar Speedle from the back. When the string is exposed on the front side of the guitar through the spherical portion the string and Guitar Speedle are taken out of the guitar with ease.

The invention claimed is:

1. An apparatus for inserting strings into a guitar, where the guitar body has a thickness and the string is inserted through a hole rear to front through the body, said apparatus comprising an elongated tube longer than the thickness of the guitar body and a spherically shaped portion at one end, the tube and portion with a hole extending the entire length, wherein the apparatus is inserted into the top of a string hole front to rear and the string is inserted through the tube rear to front and once the string is inserted the appliance is pulled out of the hole and off the string.

2. A method for inserting strings into a guitar, where the guitar body has a thickness and the string is inserted through a hole rear to front through the body, where steps of operation are to insert an apparatus comprising an elongated tube longer than the thickness of the guitar body and a spherically shaped portion at one end, the tube and portion with a hole extending the entire length into the front of the guitar, then feed string through the tube from rear of guitar, followed by extracting the tube out of the front of the guitar.

* * * * *